US007059066B2

(12) United States Patent
Maurer

(10) Patent No.: US 7,059,066 B2
(45) Date of Patent: Jun. 13, 2006

(54) METHOD AND APPARATUS FOR THE PRODUCTION AND TREATMENT OF A MATERIAL WEB

(75) Inventor: Joerg Maurer, Steinheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 490 days.

(21) Appl. No.: 10/360,164

(22) Filed: Feb. 6, 2003

(65) Prior Publication Data

US 2003/0150579 A1 Aug. 14, 2003

(30) Foreign Application Priority Data

Feb. 8, 2002 (DE) ..... 102 05 220

(51) Int. Cl.
*F26B 3/00* (2006.01)

(52) U.S. Cl. ..... 34/446; 34/117

(58) Field of Classification Search ..... 34/380, 34/414, 443, 446, 117; 162/204, 207; 100/331; 118/712; 242/527

See application file for complete search history.

(56) References Cited

U.S. PATENT DOCUMENTS

| | | | | |
|---|---|---|---|---|
| 2,370,811 A * | 3/1945 | Whitney | 34/389 |
| 4,945,654 A * | 8/1990 | Mason | 34/446 |
| 5,619,807 A | 4/1997 | Conrad | 34/414 |
| 5,649,448 A * | 7/1997 | Koskimies et al. | 73/159 |
| 6,440,271 B1 * | 8/2002 | Heikkinen et al. | 162/207 |

FOREIGN PATENT DOCUMENTS

| | | |
|---|---|---|
| GB | 775300 | 1/1954 |
| WO | WO 00/03088 | 1/2000 |
| WO | WO 01/55504 | 8/2001 |
| WO | 2005/052252 * | 6/2005 |

* cited by examiner

*Primary Examiner*—S. Gravini
(74) *Attorney, Agent, or Firm*—Taylor & Aust, P.C.

(57) ABSTRACT

A method and an apparatus for the production and processing of a material web, specifically a paper or cardboard web are described, whereby the material web is first wound and subsequently unwound for a subsequent finishing process and whereby the material web after being wound and prior to the finishing process is remoistened so that its moisture immediately prior to the finishing process is higher than that immediately prior to winding.

20 Claims, 2 Drawing Sheets

METHOD AND APPARATUS FOR THE PRODUCTION AND TREATMENT OF A MATERIAL WEB

BACKGROUND OF THE INVENTION

1. Field of the Invention

The invention relates to a method, as well as to an apparatus for the production and treatment of a material web, and more particularly to a method and an apparatus for the production and treatment of a paper or cardboard web.

2. Description of the Related Art

A material web may be calendered in an off-line operation, for example, in the production of SC-A papers. The material web, which is calendered in an off-line operation for the production of SC-A papers, normally includes the following steps:

Drying of SC base paper to a low moisture content, for example to 2.5%, at the end of the dryer section of the respective paper machine.

High intensity moisturizing of the material web to a high moisture content—for example to 9.7%—by means of a moisturizing unit after the dryer section.

Winding of the material web at high moisture at the end of the paper machine

Unwinding of the highly moistened reel spool in the calender

Calendering

Winding of the calendered paper.

The quality of calendered paper (gloss, smoothness) increases with increasing moisture in the base paper in the calender unwind and with increasing temperature and line force in the area of the calender rolls. A problem with calenders is that they are operated at their limits with regard to the temperature and the line force in the area of the calender rolls, thereby creating the danger of destruction and a relatively high wear and tear rate, as well as related low life spans of the roll covers.

Another problem is that, if a certain moisture content is exceeded after the moistener following the paper machine, considerable winding defects occur in the paper that is wound by the paper machine, resulting in increased waste as well as reduced runability and reduced capacity problems at the calender.

The remoistening that has hitherto been provided, as standard in off-line production of SC papers, was to prevent moisture from penetrating through the entire web, thereby providing moisture only to the top and bottom sides of the material web. Otherwise the web could be simply run at a higher moisture content coming from the dryer section, and could be wound without subsequent moistening.

During the storage, at the end of the paper machine, of the base paper that was wound while moist, a kind of "ripening" occurs in the reel spool. This is necessary to achieve the desired quality in the calendered finished product. In conventional paper machines, which are utilized in the manufacture of SC papers in on-line operation, gloss and smoothness are produced with paper that is not remoistened.

SUMMARY OF THE INVENTION

The present invention includes an improved method, as well as an improved device for the production and treatment of a paper or cardboard web. There is particular emphasis on improving the efficiency and the quality during the paper production in an off-line-operation.

The present invention, comprises in one form thereof, a method for the production and handling of a material web, specifically a paper or cardboard web, whereby the material web is first wound and subsequently unwound for a subsequent finishing process. The material web is moistened after being wound and prior to the final processing step, so that its moisture content immediately prior to the finishing step is higher than immediately prior to being wound.

In one embodiment of the method, in accordance with the present invention, the material web is wound at the end of a production machine, preferably a paper machine, and is again unwound subsequent to this production machine for the following finishing step. In this particular example, the material web is moistened to a higher moisture content, following a winding process, at the end of a production or paper machine.

The finishing step may specifically include calendering. In this instance the web runs preferably through one or several calenders in order to calender the web. The finishing step can occur in an off-line operation.

An advantage of the present invention is that the web is moistened to a higher moisture level only after being wound. The material web is remoistened to a higher moisture level, preferably only immediately prior to the finishing step.

In accordance with another embodiment of the method according to the present invention, the material web is moistened following the winding process but prior to the finishing process to a moisture level that is selected, based on at least one quality parameter for the finished material web, that relates to a characteristic for the finishing step. If the finishing process involves calendering, then the material web is moistened after being wound and prior to being calendered, preferably to a moisture level that is selected based on predetermined gloss and smoothness values.

It is also particularly advantageous that the material web is moistened prior to being wound, not exceeding a moisture level that is critical with regard to winding and/or subsequent unwinding, and the level is selected based on a predetermined maximum permissible failure frequency during winding or unwinding. Moistening of the material web occurs after winding and prior to the finishing step, by way of at least one moistening device. If the material web is to be moistened prior to winding, then an additional moistening device is installed for this purpose.

In accordance with another embodiment of the method, according to the present invention, the material web is moistened to a level of greater than 10% after winding and prior to the finishing step. The material web may be moistened to a total moisture content in the range of 12%.

If the material web is moistened prior to winding with an additional moistening device, then the material web is moistened to a content of preferably <10%. Advantageously, the material web is moistened to a moisture content of <9.7% and preferably to a moisture content of <9%.

In accordance with yet another embodiment of the method, in accordance with the current invention, the material web is dried to a moisture level in the range of between 10% and 6% prior to being wound.

In certain instances it is advantageous if the material web is dried prior to being wound, to a dry content of >97%. Alternatively, the material web may be moistened to a moisture content of at least 6% prior to being wound.

In accordance with yet another embodiment of the present invention, only the moisture profile is influenced by local moistening and/or drying, thereby creating a desired moisture cross profile.

The device, in accordance with the present invention, for the production and treatment of a material web, specifically a paper or cardboard web, implements a method including steps in which a material web is first wound and subsequently unwound for a finishing step. The finishing step includes using at least one moistening device by which the material web is moistened after being wound and prior to the finishing step, so that the moisture level immediately prior to the finishing step is higher than the moisture level immediately prior to winding.

The method, in accordance with an embodiment of the present invention, as well as the device in accordance may specifically be utilized for the purpose of improving the efficiency and the quality during the paper production in an off-line operation. The following process steps are feasible:

The base paper is moistened prior to winding or rewinding such that during winding, at the end of the paper machine or during unwinding in the calender, no winding defects occur.

Moistening to the level that is technologically required for gloss and smoothness in the finished paper, occurs only shortly prior to the last processing step, for example calendaring, by way of an additional device, specifically a second moistening device.

The present invention renders the prior methods, that include winding paper with a high moisture content, obsolete. It is, for example, possible with the present invention to remoisten the material web to a moisture content of <10% and specifically to a moisture content of approximately 9% at the end of the paper machine by way of a first moistening device, and/or to remoisten the material web between the unwinding apparatus and the calendering apparatus to a moisture content of >10%, and specifically to a moisture content of approximately 12%.

Remoistening of the web between the unwinder and the rewinder by way of roll slitters is also feasible, which is associated with a certain weight increase. However, the objective of calendering is to achieve higher gloss and smoothness values.

The remoistening of the material web, specifically prior to the last winding process, by way of a first moistening device that controls the moisture content, such that no initial winding defects occur. The moistening, to the technologically required content, appropriately occurs only shortly prior to the final process or finishing step. This is accomplished by way of a second moistening device.

In the manufacture of SC paper it is sufficient, from a technological point of view, if a majority of the moisture is supplied by way of a first moistening unit for the "ripening" effect and the remainder of the moisture that exceeds the "critical moisture" requirement for winding, for example 10%, is supplied by a second moistening device.

The layout includes two moistening devices, which offers the advantage that the total moisture can be distributed in a desired relationship by a suitable configuration of the two moistening devices. A so-called "ripening" is possible with regard to moistening prior to the winder, while no such "ripening" occurs with respect to the moistening after unwinding or immediately prior to calendering.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
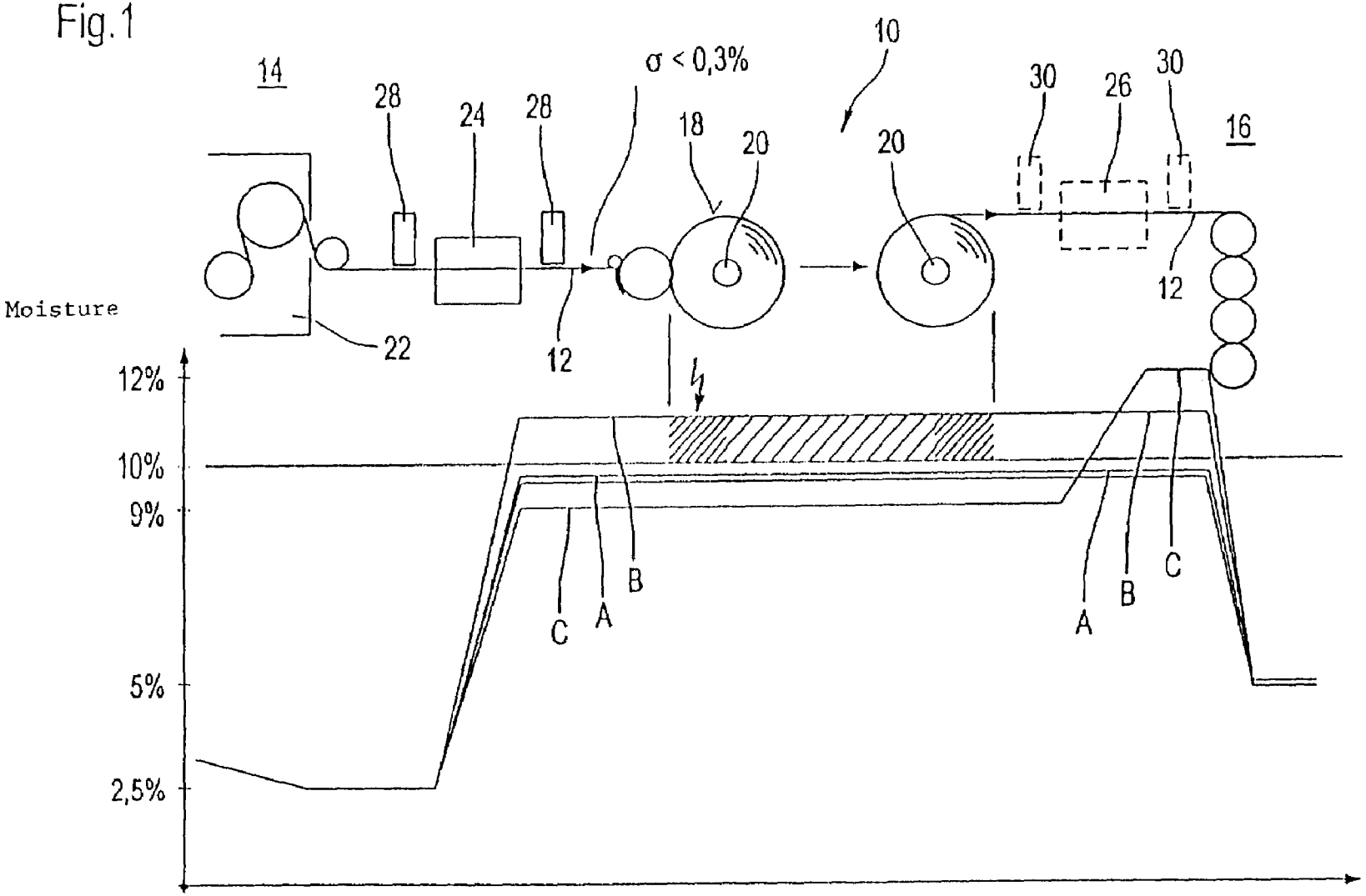
FIG. 1 is a schematic partial illustration of a device for the production or treatment of a material web of an embodiment of the present invention.

Referring now to the drawings, and more particularly to FIG. 1 there is illustrated, in a partial schematic, a device 10 for the production and treatment of a material web 12, specifically a paper or cardboard web. Device 10 includes a paper machine 14 and a calender 16.

Material web 12 is initially wound on a winding apparatus 18 onto a reel spool 20 and is unwound again in calender 16 for the subsequent finishing step, such as calendering. A first moistening device 24 is provided between a dryer section 22 of paper machine 14 and winding apparatus 18 in which material web 12 can be moistened prior to being wound, that is prior to winding apparatus 18. A scanner 28 is provided before and after moistening device 24, viewed in direction of travel of web 12, through which the respective moisture content can be measured.

In the lower section of the diagram in FIG. 1 the relative moisture in material web 12 is plotted along the distance extending from dryer section 22 of paper machine 12 to calender 16. As can be seen, from the diagram in FIG. 1, material web 12 possesses a moisture content of approximately 2.5% immediately following dryer section 22. Material web 12 is then remoistened by way of first moistening device 24.

According to curve A of FIG. 1, material web 12 is moistened to a moisture content of <10%, or more specifically, approximately 9.75%. This moisture is essentially retained until calender 16. It has been demonstrated that virtually no winding defects occur at this moisture level. However, a moisture progression that is consistent with curve A is disadvantageous in that values which are considered optimum for calendering are not achieved.

According to curve B, material web 12 is moistened to a level of >10%, or as shown in FIG. 1 to approximately 11%, whereby the moisture that was achieved prior to winding apparatus 18 is again essentially retained until reaching calender 16. A remoistening to a level of >10% enables more effective calendering. It has however been demonstrated that with a moisture of >10%, considerable winding defects occur in the reel spool.

In accordance with an embodiment of the present invention, material web 12 is remoistened after winding in winding apparatus 18 and prior to calendering in calender 16 by way of second moistening device 26, so that the moisture of web 12, immediately prior to the finishing step, in this example immediately prior to calender 16, is higher than immediately prior to winding, that is immediately prior to winding apparatus 18. A corresponding moisture progression is shown, for example, in curve C of FIG. 1. The moisture is increased to a level of <10% by way of first moistening device 24, which is provided prior to winding apparatus 18, and increased to a moisture of >10%, in this example to 12%, by way of second moistening device 26, which is provided after the unwinder and prior to calender 16. The remoistening, as illustrated in curve C, specifically illustrates the goal of the present invention in that the final moisture in calender 16 possesses the desired relatively high value, while at the same time winding defects are practically eliminated due to the low moisture in the area of winding apparatus 18.

Material web 12 is remoistened to a moisture level of preferably <10% prior to winding. The relevant remoistening occurs by way of first moistening device 24. Here, material web 12 is moistened to a level of <9.7%, and preferably to a level of <9%.

Specifically for economic reasons, drying to a moisture in the range of between 10% and 6% may occur prior to winding apparatus 18 or first moistening device 24. Remoistening prior to winding apparatus 18, by way of first moistening device 24, is not imperative.

A suitable controlled winding parameter is the line force is generated in the winding nip of winding apparatus 18. Other examples of controlled winding parameters are also the web tension or the centric moment.

Material web 12 is remoistened by way of second moistening device 26 to a moisture that is higher than that immediately prior to winding apparatus 18. A scanner 30 may be provided before and after moistening device 26, viewed in the direction of travel of web 12.

A moisture cross profile, such as curve C, is controllably provided when remoistening web 12 prior to winding apparatus 18 or prior the finishing step, such as calender 16, whereby this moisture profiling is usually considered a prime mission. The incorporation of at least one control circuit in device 10 includes the control of all relevant paper quality parameters. After calendering, by way of calender 16, material web 12 is rewound.

Drying material web 12 to a dry content of >97% advantageously allows the moisture profile to be influenced only by the local remoistening and/or local drying. As indicated in FIG. 1, a moisture $\sigma$ of web 12 may be <0.3% prior to winding apparatus 18.

Figure 2:
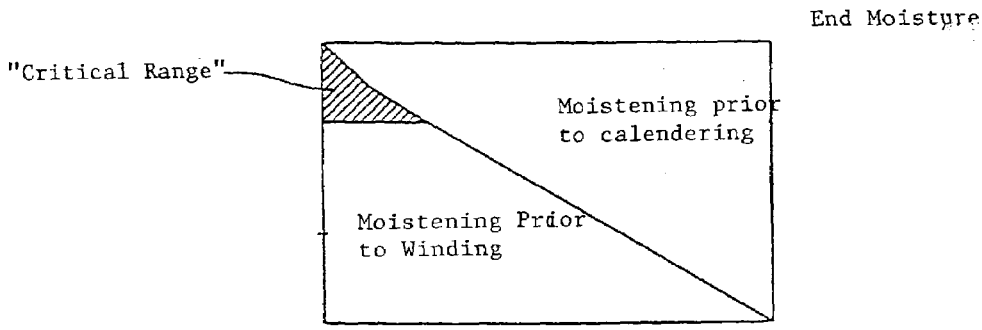
FIG. 2 is a diagram in which various moisture levels are stated, purely schematically, to the level of which the material web of FIG. 1, can practically be moistened prior to winding.
Figure 2:
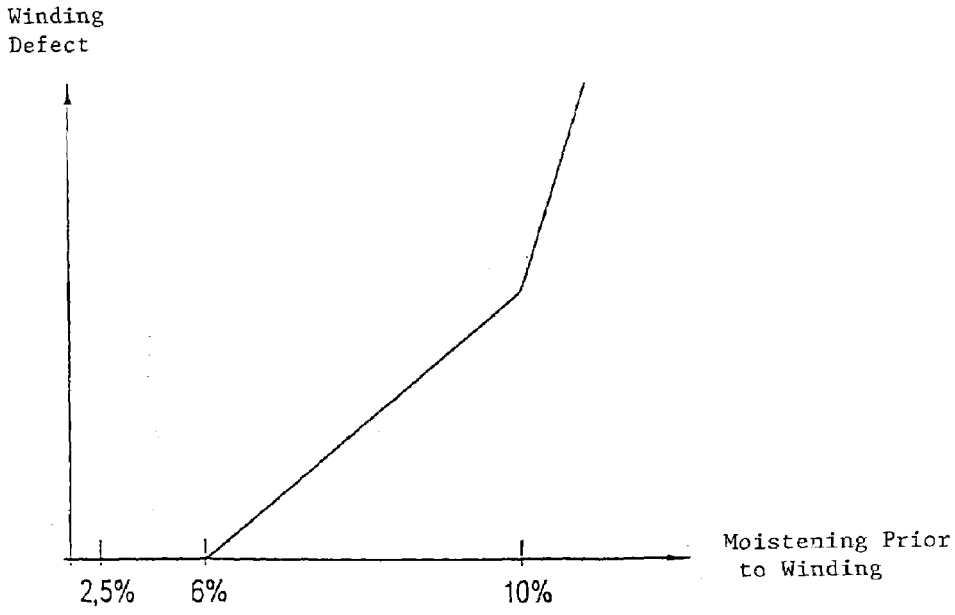

As can be seen, especially in FIG. 2, material web 12 is moistened to a moisture content of at least 6% prior to being wound in winding apparatus 18. FIG. 2 shows schematically, various moisture levels to which material web 12 may advantageously be moistened. According to this figure the appropriate moisture is in the range of, approximately 6% to approximately 10%. In this example the final moisture required for calendering is higher than 10%. The increase in moistening necessary to achieve this final moisture, can be distributed in the desired manner, specifically between moistening devices 24 and 26. It can also again be seen from the diagram that the moisture at the end of dryer section 22 of paper machine 14 could advantageously be approximately 2.5%.

FIG. 2 illustrates the number of winding defects that can be expected based on the moistening prior to winding. That is the total winding/unwinding failure frequency versus the moisture content of material web 12. In the upper portion of FIG. 2, there is shown the amount of moistening prior to winding and the amount of moistening to add after unwinding and prior to calendering.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for the production and processing of a material web, comprising the steps of:

drying the material web to a dry content of greater than 97%;

remoistening the web to a first moisture content of at least 6%;

winding the material web, the material web having said first moisture content;

unwinding the material web;

finishing the material web; and moistening the material web after said winding step and prior to said finishing step such that the material web has a second moisture content, said second moisture content being greater than said first moisture content.

2. The method of claim 1, wherein said winding step is performed after the material web leaves a paper machine and said unwinding step is performed after said winding step.

3. The method of claim 1, wherein said finishing step includes the step of calendering the material web.

4. The method of claim 1, wherein said finishing step includes at least one finishing treatment step occurring in an off-line operation.

5. The method of claim 1, wherein said moistening step is performed after said unwinding step.

6. The method of claim 1, wherein said moistening step is performed immediately prior to said finishing step.

7. The method of claim 1, wherein said moistening step includes the step of selecting a moisture level associated with at least one quality parameter for a finished material web, said at least one quality parameter being a characteristic of said finishing step.

8. The method of claim 7, wherein said finishing step includes a substep of calendering the material web, said moisture level being selected based on predetermined gloss and smoothness values.

9. The method of claim 1, further comprising the steps of:

selecting a predetermined moisture level based on a predetermined maximum permissible winding/unwinding failure frequency; and moistening the material web to said predetermined moisture level prior to said winding step.

10. The method of claim 9, wherein said moistening step performed prior to said winding device is accomplished with at least one moistening device.

11. The method of claim 1, wherein said moistening step is accomplished with at least one moistening device.

12. The method of claim 1, wherein said second moisture content is greater than approximately 10%.

13. The method of claim 12, wherein said second moisture content is approximately 12%.

14. The method of claim 1, further comprising the step of moistening the material web prior to said winding step such that said first moisture content is less than approximately 10%.

15. The method of claim 14, wherein said step of moistening the material web prior to said winding step includes moistening the material web such that said first moisture content is less than approximately 9.7%.

16. The method of claim 15, wherein said step of moistening the material web prior to said winding step includes moistening the material web such that said first moisture content is less than approximately 9%.

17. The method of claim 1, further comprising the step of drying the material web prior to said winding step such that said first moisture content is less than approximately 10% and more that approximately 6%.

18. The method of claim 1, wherein said moistening step includes at least one of local moistening and local drying, which influences only a moisture cross-profile.

19. An apparatus for the production and processing of a material web, comprising:

a dryer section within which the material web is dried to a dry content of greater than 97%;

a winding device upon which the material web is wound with a first moisture content, said first moisture content being greater than 6%;

a finishing device; and at least one moistening device through which the material web is moistened to a second moisture content between the time the material web is wound by said winding device and prior to entering said finishing device, said second moisture content being higher than said first moisture content.

20. The apparatus of claim 19, further comprising at least one additional moistening device positioned to moisten the material web prior to being wound by said winding device.

* * * * *